US012565396B1

(12) United States Patent
Kyzar

(10) Patent No.: US 12,565,396 B1
(45) Date of Patent: Mar. 3, 2026

(54) WIRE ROLLERS

(71) Applicant: Benjamin A. Kyzar, Loranger, LA (US)

(72) Inventor: Benjamin A. Kyzar, Loranger, LA (US)

( * ) Notice: Subject to any disclaimer, the term of this patent is extended or adjusted under 35 U.S.C. 154(b) by 86 days.

(21) Appl. No.: 18/656,778

(22) Filed: May 7, 2024

(51) Int. Cl.

| | |
|---|---|
| ***B65H 54/00*** | (2006.01) |
| ***B65H 54/10*** | (2006.01) |
| ***B65H 54/40*** | (2006.01) |
| ***B65H 54/44*** | (2006.01) |
| ***B65H 54/547*** | (2006.01) |
| ***B65H 54/74*** | (2006.01) |
| ***B65H 75/14*** | (2006.01) |

(Continued)

(52) U.S. Cl.
CPC ..... *B65H 54/00* (2013.01); *B65H 54/40* (2013.01); *B65H 54/44* (2013.01); *B65H 54/547* (2013.01); *B65H 54/74* (2013.01); *B65H 75/14* (2013.01); *B65H 75/22* (2013.01); *B65H 75/2245* (2021.05); *B65H 75/28* (2013.01); *B65H 75/30* (2013.01); *B65H 75/42* (2013.01); *B65H 75/4481* (2013.01); *B65H 75/4486* (2013.01); *B65H 75/4494* (2013.01); *B65H 54/106* (2013.01); *B65H 2403/532* (2013.01); *B65H 2701/36* (2013.01)

(58) Field of Classification Search
CPC ..... B65H 54/00; B65H 54/04; B65H 54/106; B65H 54/40; B65H 54/44; B65H 54/54; B65H 54/547; B65H 54/74; B65H 75/00; B65H 75/14; B65H 75/143; B65H 75/146; B65H 75/22; B65H 75/2245; B65H 75/28; B65H 75/30; B65H 75/305; B65H 75/406; B65H 75/42; B65H 75/425; B65H 75/4481; B65H 75/4486; B65H 75/4492; B65H 75/4494; B65H 2701/34; B65H 2701/36; B65H 2701/361; B65H 2701/362; B65H 2701/363; B65H 2701/364; B65H 2403/532; B65H 2403/4321; B65H 55/00; B65H 55/04; B65H 2403/5321; B21F 3/00; B21F 3/04
See application file for complete search history.

(56) References Cited

U.S. PATENT DOCUMENTS

| | | | | |
|---|---|---|---|---|
| 152,784 | A | 7/1874 | Westenhaver et al. | |
| 522,503 | A * | 7/1894 | De Bem ..... | B65H 75/425 242/270 |

(Continued)

*Primary Examiner* — Anna M Momper
*Assistant Examiner* — Raveen J Dias
(74) *Attorney, Agent, or Firm* — R. Keith Harrison

(57) ABSTRACT

Wire rollers may include a wire roller assembly including a rotatable roller assembly shaft. A first roller assembly plate may be on the roller assembly shaft and a second roller assembly plate may be on the roller assembly shaft. At least one of the first roller assembly plate and the second roller assembly plate may be selectively removable with respect to the roller assembly shaft. A roller space may be between the first roller assembly plate and the second roller assembly plate. A wire roller disk may be in the roller space and engaged for rotation by the roller assembly shaft. The wire roller disk may be configured to releasably retain at least one end of a wire segment. A roller assembly actuator may operably engage the roller assembly shaft of the wire roller assembly for rotation of the roller assembly shaft and the wire roller disk.

4 Claims, 17 Drawing Sheets

(51) Int. Cl.

| | |
|---|---|
| ***B65H 75/22*** | (2006.01) |
| ***B65H 75/28*** | (2006.01) |
| ***B65H 75/30*** | (2006.01) |
| ***B65H 75/42*** | (2006.01) |
| ***B65H 75/44*** | (2006.01) |

(56) References Cited

U.S. PATENT DOCUMENTS

| | | | | | |
|---|---|---|---|---|---|
| 952,582 | A | | 3/1910 | Ritter | |
| 1,238,445 | A | | 8/1917 | Scholl | |
| 1,253,782 | A | | 1/1918 | Bryan | |
| 1,944,669 | A | * | 1/1934 | Purdy | B65H 75/406 242/395 |
| 2,530,576 | A | | 11/1950 | Gregory | |
| 2,545,332 | A | | 3/1951 | Young | |
| 3,066,879 | A | | 12/1962 | Emberson et al. | |
| 3,558,101 | A | * | 1/1971 | Ward | A01K 89/015 242/395 |
| 3,973,741 | A | * | 8/1976 | Dean | A01K 89/003 242/395 |
| 4,190,211 | A | * | 2/1980 | Janzen | B65H 49/32 242/599.3 |
| 4,437,622 | A | | 3/1984 | Heider | |
| 4,540,136 | A | * | 9/1985 | Rauch | B65H 54/106 242/396.9 |
| 5,186,410 | A | * | 2/1993 | Toews | B65H 49/32 254/323 |
| 5,370,326 | A | * | 12/1994 | Webb | B65H 54/547 242/395 |
| 5,584,444 | A | * | 12/1996 | Farmer | B65H 54/553 242/395 |
| 6,398,147 | B1 | * | 6/2002 | Fredrickson | B65H 75/305 242/390.8 |
| 6,648,262 | B1 | * | 11/2003 | Huffman | B65H 75/305 242/390.8 |
| 8,702,029 | B1 | * | 4/2014 | Thompson | B65H 49/327 242/403 |
| 8,827,198 | B1 | * | 9/2014 | Steadman, Sr. | B65H 75/305 242/613.2 |
| 10,526,812 | B1 | * | 1/2020 | Vogeler | B65H 75/425 |
| 10,618,770 | B1 | * | 4/2020 | Vogeler | B65H 75/4402 |
| 10,660,321 | B2 | * | 5/2020 | Tseng | A01K 89/003 |
| 11,472,660 | B1 | * | 10/2022 | DeBellis | B65H 75/406 |
| 11,505,424 | B2 | * | 11/2022 | Snyder | B65H 54/54 |
| 2009/0236459 | A1 | * | 9/2009 | McMann | B65H 75/305 242/390.9 |
| 2013/0161430 | A1 | * | 6/2013 | Weissbrod | B23K 9/1333 242/125.1 |
| 2017/0064933 | A1 | * | 3/2017 | Tseng | B65H 54/12 |
| 2018/0022567 | A1 | * | 1/2018 | Strength | B65H 54/106 242/362 |

* cited by examiner

WIRE ROLLERS

FIELD

Illustrative embodiments of the disclosure are generally directed to devices for rolling wire. More particularly, illustrative embodiments of the disclosure are directed to wire rollers which may be suitable for rolling tie wire segments of a tie wire preparatory to using each rolled tie wire segment to secure an electrical distribution line to an electrical insulator.

SUMMARY

Illustrative embodiments of the disclosure are generally directed to wire rollers configured to roll a wire segment. An illustrative embodiment of the wire rollers may include a wire roller assembly including a rotatable roller assembly shaft. A first roller assembly plate may be on the roller assembly shaft and a second roller assembly plate may be on the roller assembly shaft. At least one of the first roller assembly plate and the second roller assembly plate may be selectively removable with respect to the roller assembly shaft. A roller space may be between the first roller assembly plate and the second roller assembly plate. A wire roller disk may be in the roller space. The wire roller disk may include a disk body engaged for rotation by the roller assembly shaft. The wire roller disk may be configured to releasably retain at least one end of the wire segment. A roller assembly actuator may operably engage the roller assembly shaft of the wire roller assembly for rotation of the roller assembly shaft and the wire roller disk.

In some embodiments, the tie wire roller may include a wire roller assembly including a rotatable roller assembly shaft. A first roller assembly plate and a second roller assembly plate may be on the roller assembly shaft. A roller space may be between the first roller assembly plate and the second roller assembly plate. A wire roller disk may be in the roller space. The wire roller disk may include a disk body engaged for rotation by the roller assembly shaft. The disk body may be engaged for rotation by the roller assembly shaft and configured to releasably retain at least one end of the wire segment. A roller assembly actuator may operably engage the roller assembly shaft for rotation of the roller assembly shaft and the wire roller disk. Accordingly, the wire roller disk is configured to roll the wire segment responsive to rotation of the roller assembly shaft by operation of the roller assembly actuator. The second roller assembly plate may be selectively removable with respect to the roller assembly shaft for removal of the wire segment from the roller space after rolling of the wire segment.

In some embodiments, the tie wire roller may include a roller mount assembly. A wire roller assembly may include a roller assembly bearing supported by the roller mount assembly; a rotatable roller assembly shaft; a first roller assembly plate fixedly supported by the roller assembly shaft, the roller assembly shaft including a first shaft segment on a first side of the first roller assembly plate and a second shaft segment on a second side of the first roller assembly plate; a shaft receptacle inserted in the roller assembly bearing and removably receiving the second shaft segment of the roller assembly shaft; a second roller assembly plate carried by the shaft receptacle; a roller space between the first roller assembly plate and the second roller assembly plate; and a wire roller disk in the roller space. The wire roller disk may include a disk body engaged for rotation by the second shaft segment of the roller assembly shaft; a wire receiving cavity in the disk body, the wire receiving cavity sized and configured to releasably retain at least one end of the wire segment; and a roller assembly actuator operably engaging the first shaft segment of the roller assembly shaft for rotation of the roller assembly shaft and the wire roller disk. Accordingly, the wire roller disk is configured to roll the wire segment responsive to rotation of the roller assembly shaft by operation of the roller assembly actuator. The second roller assembly plate may be selectively removable with respect to the roller assembly shaft by removal of the second shaft segment from the shaft receptacle for removal of the wire segment from the roller space after rolling of the wire segment.

In another aspect, the roller assembly actuator may include an actuator handle.

In another aspect, the roller assembly actuator may include an actuator motor.

In another aspect, the wire roller assembly may be supported by a roller mount assembly.

In another aspect, the wire roller assembly may include a roller assembly bearing supported by the roller mount assembly, and the roller assembly shaft may be journaled for rotation in the roller assembly bearing.

In another aspect, the roller mount assembly may include a mount bracket, and the roller assembly bearing of the wire roller assembly may be supported by the mount bracket.

In another aspect, a wire shaping peg may be on the roller mount assembly.

In another aspect, a shaft receptacle may removably receive the roller assembly shaft, and the second roller assembly plate may be supported by the shaft receptacle.

These and other objects, features, and advantages of various illustrative embodiments of the present disclosure will become more readily apparent from the attached drawings and the detailed description of the illustrative embodiments, which follow.

BRIEF DESCRIPTION OF THE DRAWINGS

Illustrative embodiments of the disclosure will now be described, by way of example, with reference to the accompanying drawings, in which.

Like reference numerals refer to like parts throughout the several views of the drawings.

DETAILED DESCRIPTION

Figure 1:
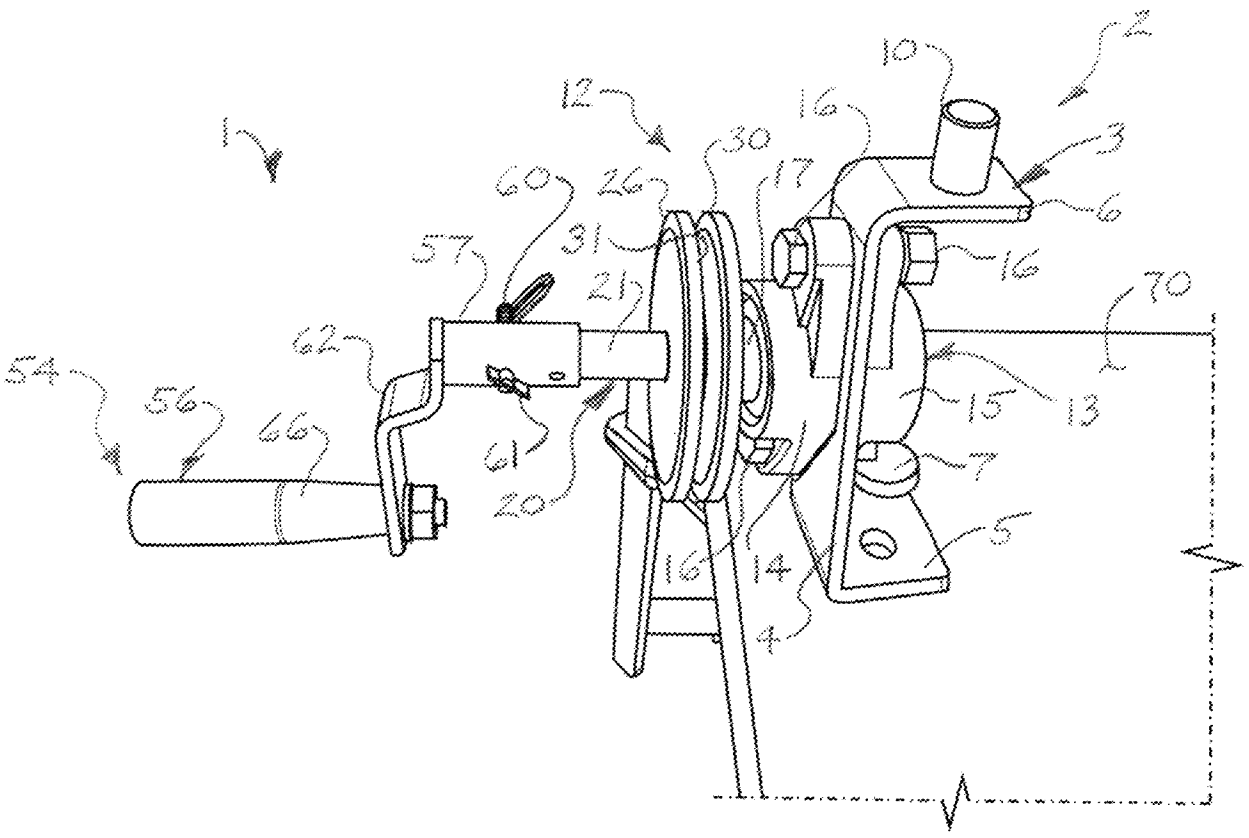
FIG. 1 is a side front perspective view of an illustrative embodiment of the wire rollers, hereinafter wire roller, mounted on a roller support surface in typical application of the wire roller.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the subject matter as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

All methods set forth in the present disclosure may be performed in any suitable order of steps unless otherwise indicated herein or contradicted by the rules of logic. The use of any and all examples or exemplary language provided herein is intended to clearly describe the subject matter of the disclosure and is not intended to be limiting on the scope of the subject matter set forth in the claims. No element, step, ingredient, or limitation mentioned or described in the specification shall not be construed as regarding any unclaimed component, step, or limitation to be essential in practicing the claimed subject matter.

Unless expressly or implicitly indicated otherwise, throughout the description and the appended claims, the terms "comprise", "comprising", "comprised of" and the like are to be construed in an inclusive sense as opposed to an exclusive or exhaustive sense, and are equivalent to the phrase, "including but not limited to". Each embodiment disclosed herein can comprise, consist essentially of, or consist of its particular stated element, step, ingredient, or limitation. As used herein, the transition terms "comprise", "comprises", "comprising", "include", "includes", "including", "is", "has", "having" or the like means "includes, but is not limited to, and allows for the inclusion of unspecified elements, steps, ingredients, or limitations, even in major amounts". The transitional phrase "consisting of" excludes any element, step, ingredient, or limitation not specified. The transition phrase "consisting essentially of" shall limit the scope of the embodiment to the specified elements, steps, ingredients, or limitations and to those that do not materially affect the embodiment. Throughout the written description, drawings and claims appended hereto, unless otherwise noted, it shall be recognized and understood that each embodiment of the described, illustrated and claimed subject matter may comprise, consist essentially of, or consist of any component, element or combination of components or elements set forth herein.

Unless otherwise noted using precise or limiting terminology, all numbers which express quantities of ingredients throughout the specification and claims are to be understood as being approximations of the numerical value cited to express the quantities of those ingredients. As used throughout the specification and claims, the term "about" has the meaning reasonably ascribed to it by a person skilled in the art when used in conjunction with a stated numerical value or range, i.e., denoting from the exact stated value or range to somewhat more or somewhat less than the stated value or range, from a deviation of from 0% with respect to the stated value or range to up to and including 20% of the stated value or range in either direction.

Various illustrative embodiments of the disclosure are described herein. Variations on the described illustrative embodiments may become apparent to those of ordinary skill in the art in reading the specification, drawings and claims of the disclosure. Accordingly, the disclosure encompassed by the specification, claims and drawings includes all modifications and equivalents of the subject matter recited in the claims as permitted by applicable law. Additionally, any combination of the elements in all possible variations thereof is encompassed by the subject matter of the disclosure unless otherwise indicated herein.

Figure 6:
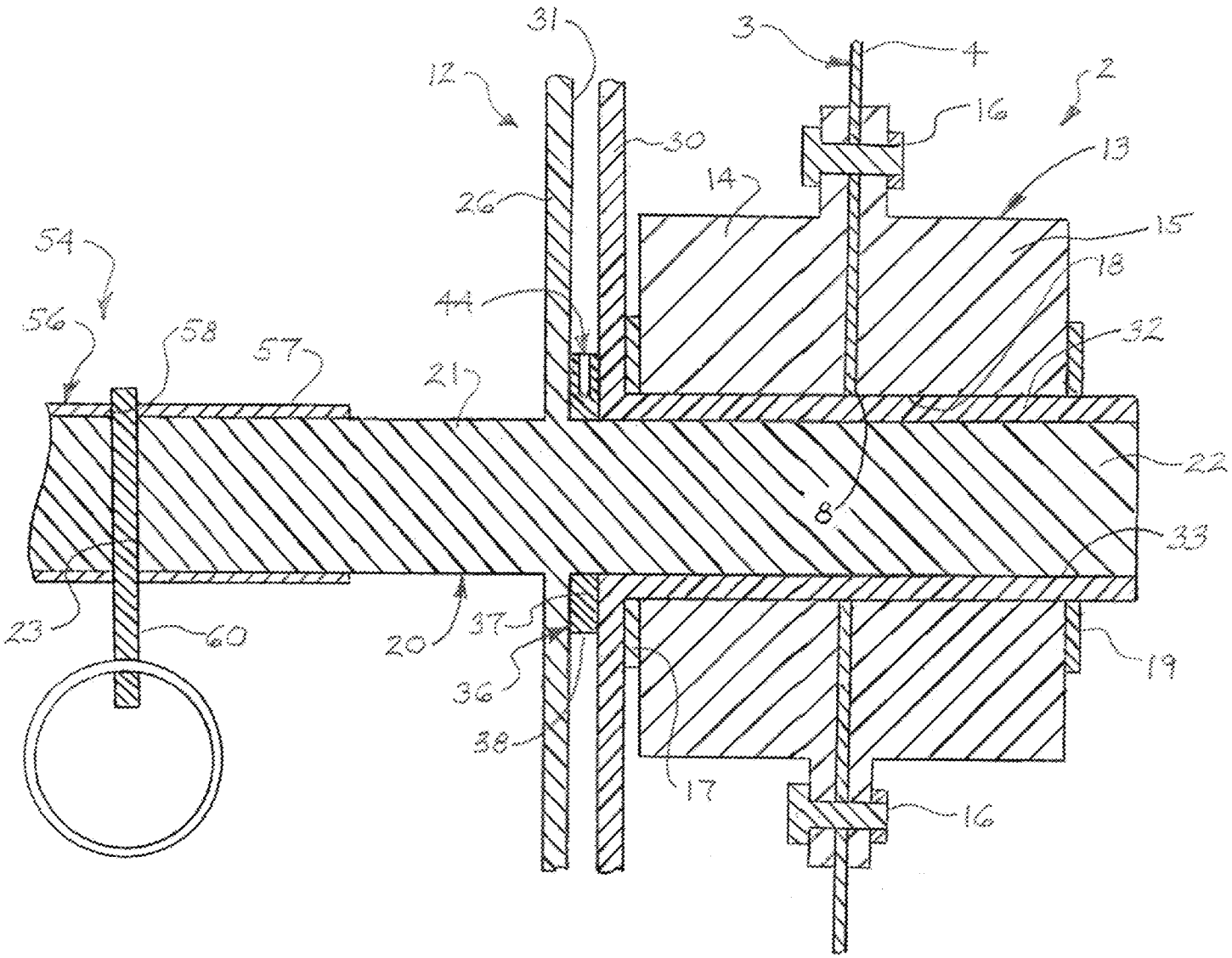
FIG. 6 is a longitudinal sectional view of a typical wire roller assembly of the wire roller, with a portion of the roller assembly actuator engaging the wire roller assembly.

Referring to the drawings, an illustrative embodiment of the wire rollers is generally indicated by reference number 1. As will be hereinafter described, the wire roller 1 may be configured to roll a wire segment 74 (FIG. 10) for any of a variety of applications. As particularly illustrated in FIGS. 1 and 2, the wire roller 1 may include a roller mount assembly 2. The roller mount assembly 2 may include any device, apparatus, structure, or combination(s) thereof suitable to support the wire roller 1 on a roller support surface 70 for operation of the wire roller 1. For example and without limitation, in some embodiments, the roller mount assembly 2 may include at least one mount bracket 3. The mount bracket 3 may have any design and configuration suitable for mounting and securing the wire roller 1 with respect to the roller support surface 70. For example and without limitation, in some embodiments, the mount bracket 3 may include a typically vertical main bracket portion 4. A bottom bracket portion 5 and a top bracket portion 6 may extend from the main bracket portion 4. The bottom bracket portion 5 may be configured for attachment to the roller support surface 70 such as by using one or more bracket fasteners 7, for example and without limitation. The roller support surface 70 may include a mounting surface on a structure such as a table or a truck bed of a pickup truck or other vehicle, for example and without limitation. As illustrated in FIG. 6, a shaft opening 8, the purpose of which will be hereinafter described, may extend through the main bracket portion 4 of the mount bracket 3. As further illustrated in FIGS. 1 and 2, a wire shaping peg 10 may extend from the top bracket portion 6 of the mount bracket 3 typically for purposes which will be hereinafter described.

A wire roller assembly 12 may include a roller assembly bearing 13. The roller assembly bearing 13 may be supported by the main bracket portion 4 of the mount bracket 3 of the roller mount assembly 2. In some embodiments, the roller assembly bearing 13 may include a front bearing housing 14 and a rear bearing housing 15. The front bearing housing 14 and the rear bearing housing 15 may be attached to respective front and rear surfaces of the main bracket portion 4 such as by using suitable bearing housing fasteners 16. As illustrated in FIG. 6, a front housing spacer 17 and a rear housing spacer 19 may be provided on the front bearing housing 14 and the rear bearing housing 15, respectively. A shaft bore 18 may extend through the front housing spacer 17, the front bearing housing 14, the shaft opening 8 in the main bracket portion 4 of the mount bracket 3, the rear bearing housing 15 and the rear housing spacer 19.

Figure 3:
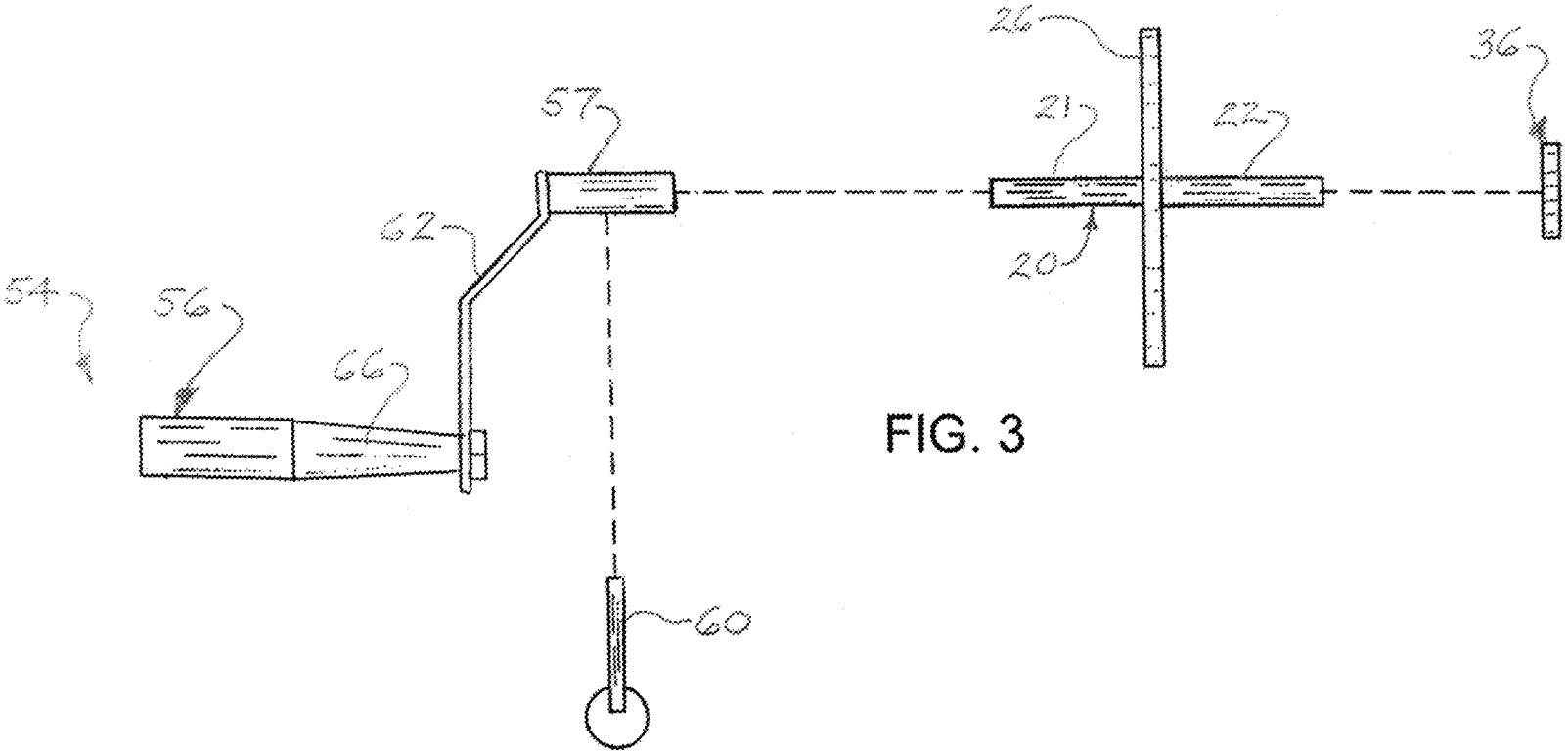
FIG. 3 is an exploded side view of a typical roller assembly actuator in the form of an actuator handle which is suitable for actuation of the wire roller assembly of wire roller.

As illustrated in FIG. 3, the wire roller assembly 12 may include a rotatable roller assembly shaft 20. A front roller assembly plate 26 may be provided on the roller assembly shaft 20. In some embodiments, the front roller assembly plate 26 may be fixed with respect to the roller assembly shaft 20 such as via welding, for example and without limitation. In some embodiments, the front roller assembly plate 26 may be cast, molded or otherwise fabricated in one piece with the roller assembly shaft 20 typically according to the knowledge of those skilled in the art.

As further illustrated in FIG. 3, the roller assembly shaft 20 may include a front shaft segment 21 and a rear shaft segment 22. The front shaft segment 21 and the rear shaft segment 22 may extend from front and rear surfaces, respectively, of the front roller assembly plate 26. As further illustrated in FIG. 6, a pin opening 23, the purpose of which will be hereinafter described, may extend transversely through the front shaft segment 21 of the roller assembly shaft 20.

Figure 4:
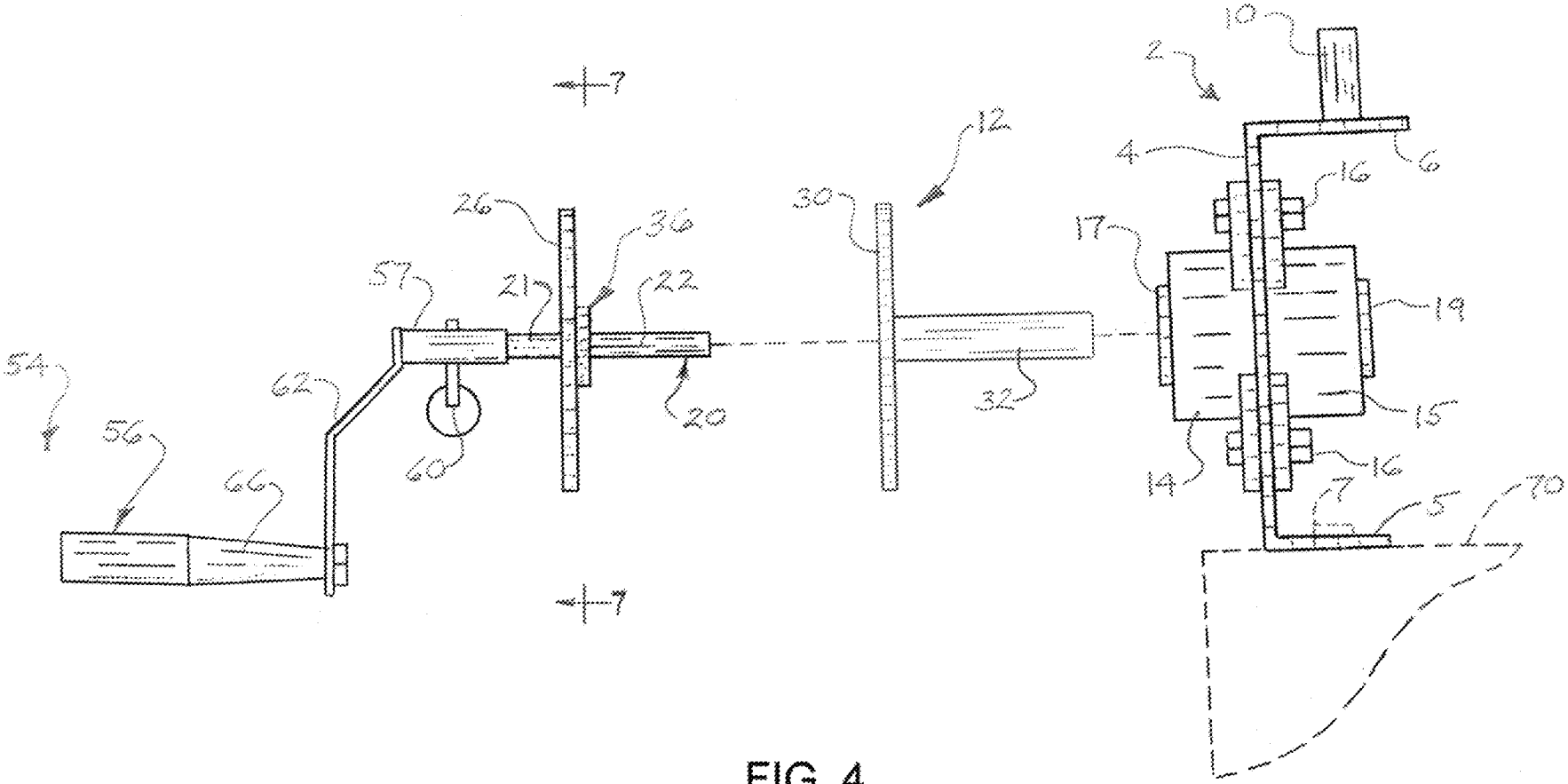
FIG. 4 is an exploded side view of the partially disassembled wire roller.
Figure 5:
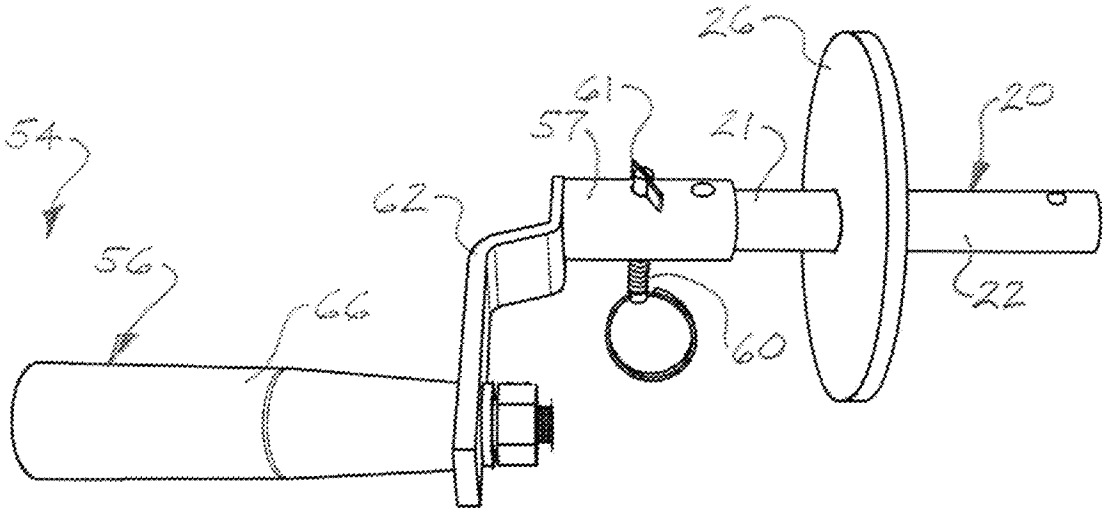
FIG. 5 is a side perspective view of a typical actuator handle as the roller assembly actuator.

As illustrated in FIGS. 4-6, the wire roller assembly 12 may include a rear roller assembly plate 30. A shaft receptacle 32, having a shaft receptacle interior 33, may extend from the rear roller assembly plate 30. As illustrated in FIG. 6, the outer width or diameter of the shaft receptacle 32 may be suitably sized for insertion into the shaft bore 18 of the roller assembly bearing 13 of the wire roller assembly 12. The inner width or diameter of the shaft receptacle interior 33 of the shaft receptacle 32 may be suitably sized and configured to removably receive the rear shaft segment 21 of the roller assembly shaft 20. Accordingly, as illustrated in FIG. 4, in typical assembly of the wire roller assembly 12, the shaft receptacle 32 on the rear roller assembly plate 30 may be inserted in the shaft bore 18 (FIG. 6) of the roller assembly bearing 13. A wire roller disk 36, which will be hereinafter described, may be placed on the rear shaft segment 22 of the roller assembly shaft 20. The rear shaft segment 22 of the roller assembly shaft 20 may be inserted into the shaft receptacle 32. A roller space 31 may be formed by and between the front roller assembly plate 26 and the rear roller assembly plate 30. The wire roller disk 36 may be disposed in the roller space 31 between the front roller assembly plate 26 and the rear roller assembly plate 30.

Figure 9:
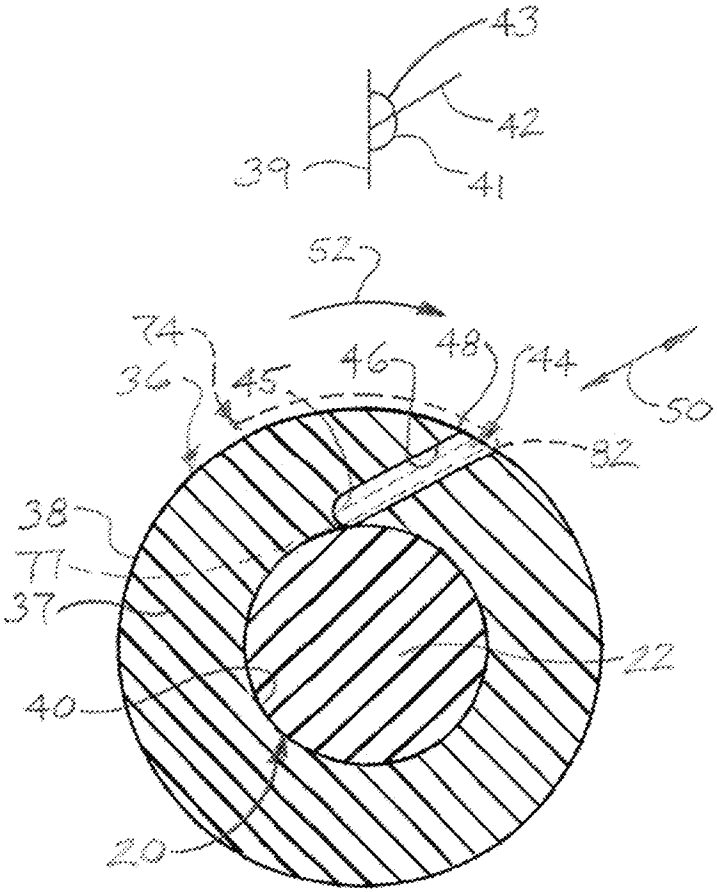
FIG. 9 is a sectional view, taken along section lines 9-9 in FIG. 8, of the wire roller disk.
Figure 8:
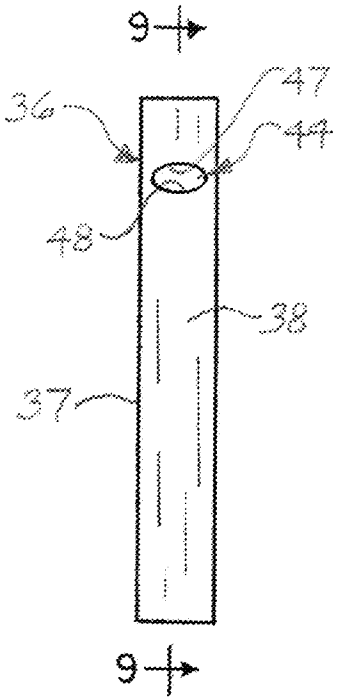
FIG. 8 is a side view of the wire roller disk.
Figure 7:
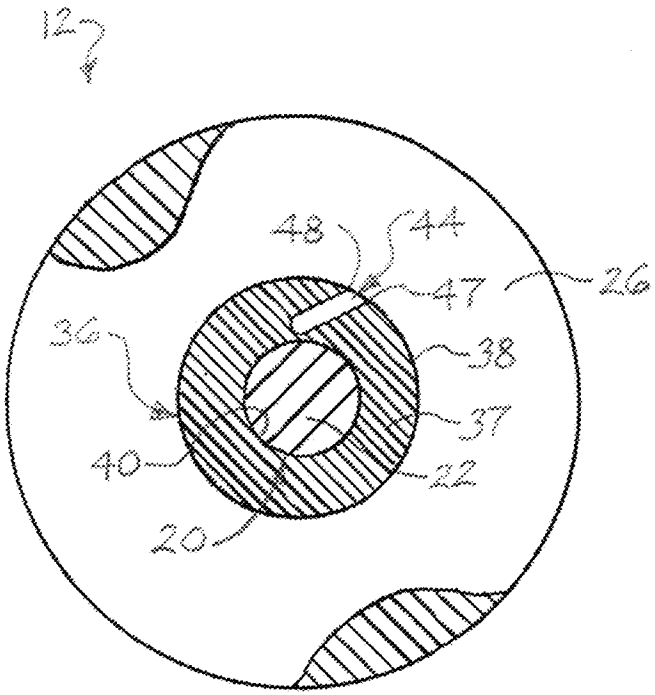
FIG. 7 is a cross-sectional view, taken along lines 7-7 in FIG. 4, of a typical wire roller disk deployed in place on a roller assembly shaft of the wire roller assembly.

As illustrated in FIGS. 7-9, the wire roller disk 36 may include a disk body 37 having an outer disk body surface 38. The disk body 37 may be engaged for rotation by the rear shaft segment 22 of the roller assembly shaft 20. Accordingly, a central shaft opening 40 may extend through the disk body 37. The rear shaft segment 22 may extend through the shaft opening 40.

The wire roller disk 36 may be suitably configured to releasably retain at least one wire segment end 77 (FIG. 9) of the wire segment 74 (FIG. 13) for rolling of the wire segment 74. Accordingly, as further illustrated in FIGS. 7-9, in some embodiments, a wire receiving cavity 44 may be provided in the disk body 37. The wire receiving cavity 44 may be sized and configured to releasably receive, engage and retain at least one, and typically, both of the wire segment ends 77 of the wire segment 74. As illustrated in FIG. 9, the wire receiving cavity 44 may have an inner cavity surface 45. Side cavity surfaces 46 may extend from the inner cavity surface 45 and terminate at the outer disk body surface 38. The wire receiving cavity 44 may have a leading cavity edge 47 and a trailing cavity edge 48 relative to the direction of rotation 52 (the clockwise direction in FIG. 9) of the wire roller disk 36. Alternative techniques and methods known by those skilled in the art may be used to releasably retain the wire segment end 77 of the wire segment 74 with respect to the wire roller disk 36. These may include clips, clamps, bolts, screws, mechanical fasteners and the like.

As further illustrated in FIG. 9, the wire receiving cavity 44 may be elongated with a longitudinal cavity axis 50. The longitudinal cavity axis 50 may be parallel to a line 42 which is oriented at an obtuse interior cavity angle 41 and at an acute exterior cavity angle 43 relative to a radial disk body axis 39 which generally intersects the inner cavity surface 45. Accordingly, as the wire roller disk 36 rotates in the direction of rotation 52 (FIG. 9), the trailing cavity edge 48 of the wire receiving cavity 44 may form a bend 82 in the wire segment 74 such that the wire segment 74 is wound into a coiled configuration on the wire roller disk 36 as the wire roller disk 36 continues to rotate.

Figure 2:
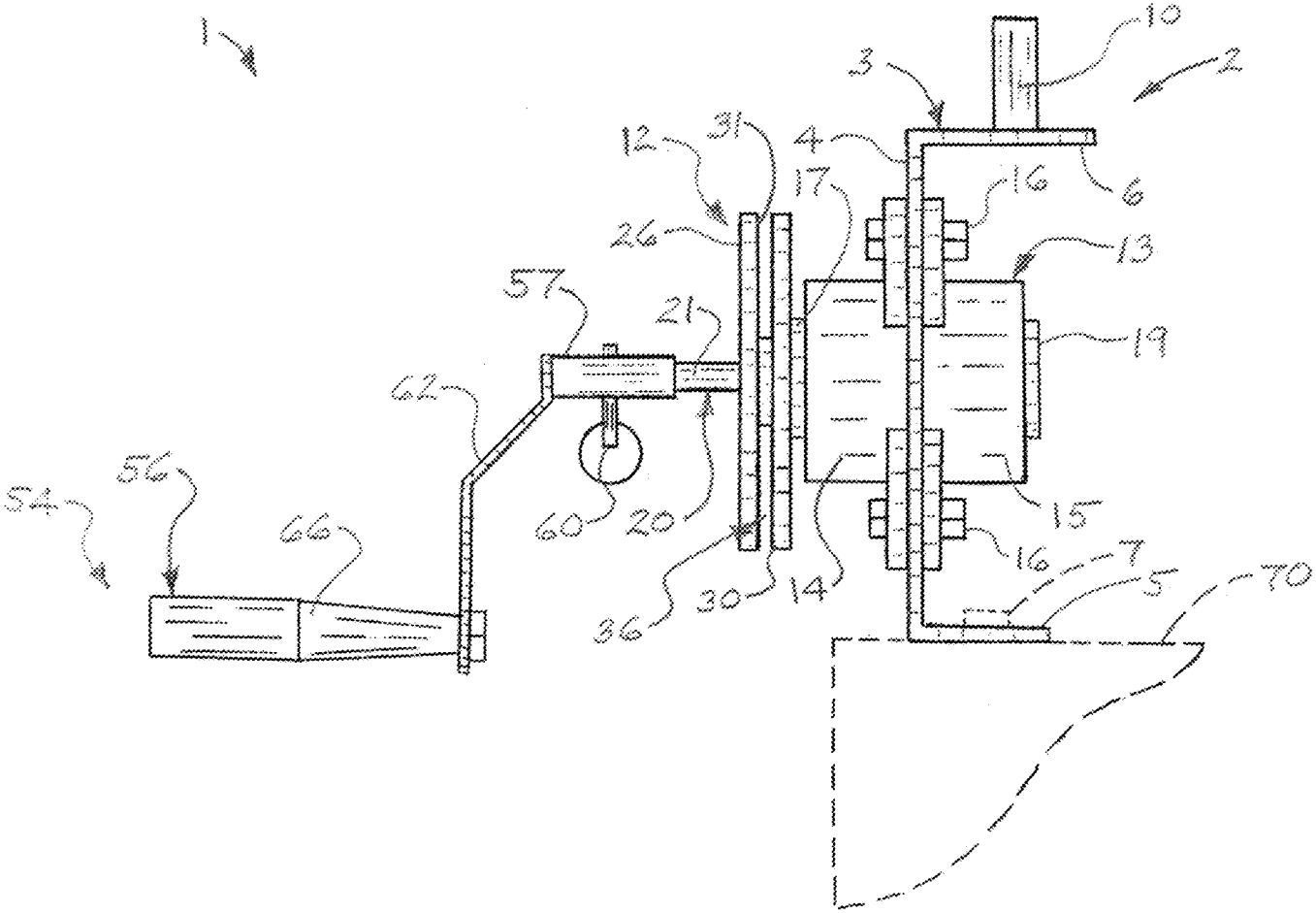
FIG. 2 is a side view of the wire roller illustrated in FIG. 1.

As illustrated in FIG. 3, a roller assembly actuator 54 may operably engage the front shaft segment 21 of the roller assembly shaft 20 of the wire roller assembly 12. The roller assembly actuator 54 may facilitate rotation of the roller assembly shaft 20 and the wire roller disk 36 for rolling of the wire segment 74. The roller assembly actuator 54 may include any type of device, apparatus, mechanism, system or combination(s) thereof which may be suitable to rotate the roller assembly shaft 20. For example and without limitation, as illustrated in FIGS. 1-4, in some embodiments, the roller assembly actuator 54 may include an actuator handle 56. As illustrated in FIGS. 1-5, the actuator handle 56 may include a shaft receptacle 57. As illustrated in FIG. 3, the shaft receptacle 57 may be suitably sized and configured to receive the front shaft segment 21 of the roller assembly shaft 20. As illustrated in FIG. 6, a pin opening 58 may extend transversely through the shaft receptacle 57. In insertion of the front shaft segment 21 of the roller assembly shaft 20 in the shaft receptacle 57, the pin opening 58 in the shaft receptacle 57 may register with the pin opening 23 in the front shaft segment 21. A handle retaining pin 60 may be extended through the registering pin openings 23, 58 to detachably attach the actuator handle 56 to the roller assembly shaft 20 of the wire roller assembly 12. As illustrated in FIG. 1, a cotter pin 61 may be fitted on the protruding extending or distal end of the handle retaining pin 60 to retain the handle retaining pin 60 in the pin openings 23, 58.

Figure 13:
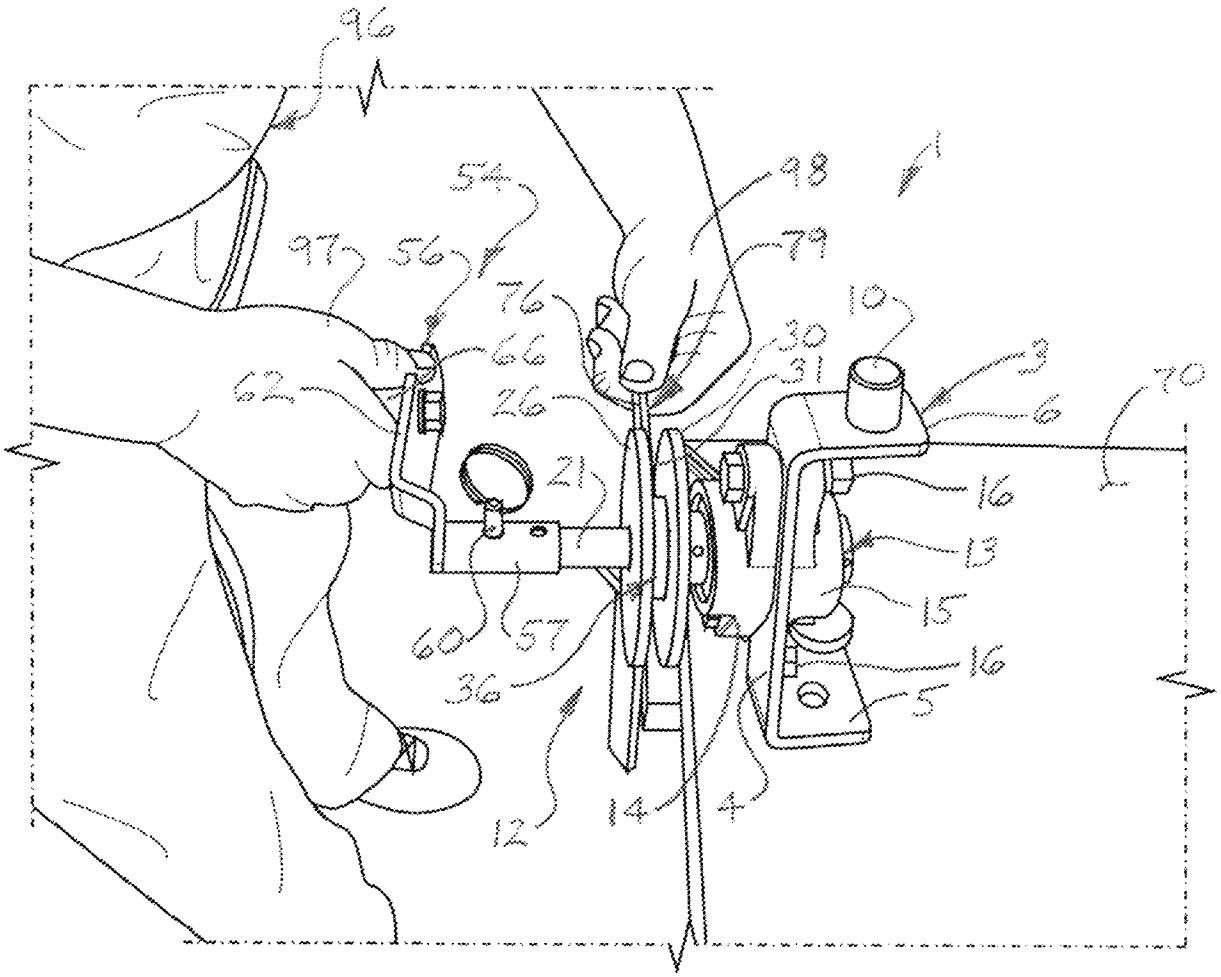
FIG. 13 is a perspective view of the wire roller as the operator places the looped wire segment into engagement with the wire roller assembly of the wire roller preparatory to rolling the looped wire segment into a coiled wire segment (not shown)

An elongated handle flange 62 may extend transversely from the shaft receptacle 57. A hand grip 66 may extend from the extending or distal end of the handle flange 62. Accordingly, as illustrated in FIG. 13, an operator 96 of the wire roller 1 may grasp and rotate the hand grip 66 to transmit rotation from the handle flange 62 through the shaft receptacle 57 to the roller assembly shaft 20 of the wire roller assembly 12.

Figure 24:
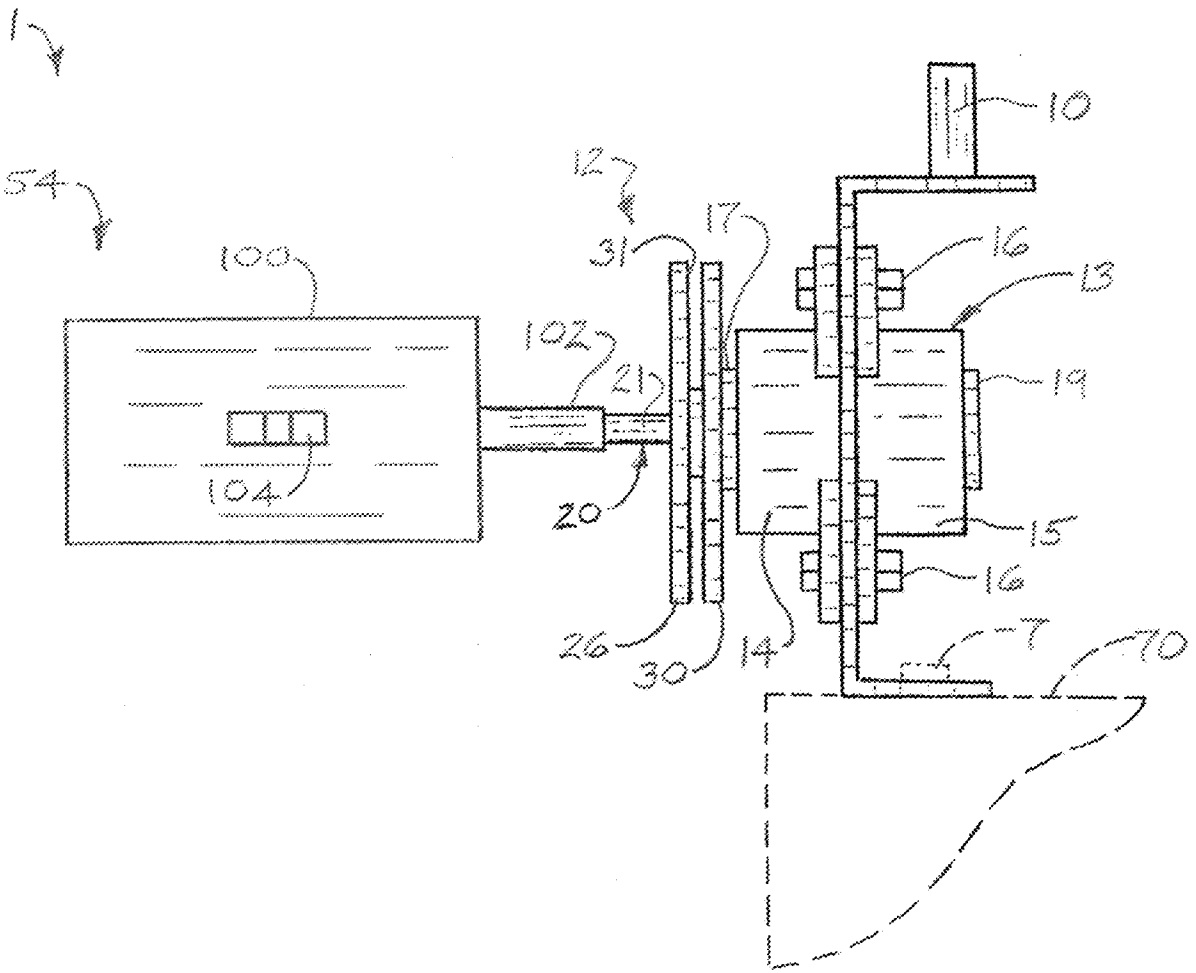
FIG. 24 is a side view of the illustrative wire roller having a roller assembly actuator with an actuator motor drivingly engaging the wire roller assembly.

As illustrated in FIG. 24, in some embodiments, the roller assembly actuator 54 may include an actuator motor 100 having a motor drive shaft 102. The motor drive shaft 102 of the actuator motor 100 may be drivingly coupled to the front shaft segment 21 of the roller assembly shaft 20 typically according to the knowledge of those skilled in the art. Accordingly, the actuator motor 100 may be operated to transmit rotation from the motor drive shaft 102 to the roller assembly shaft 20 of the wire roller assembly 12. The actuator motor 100 may include a motor control interface 104. The motor control interface 104 may include power, speed and other control features for controlling various parameters of the actuator motor 100.

Figure 21:
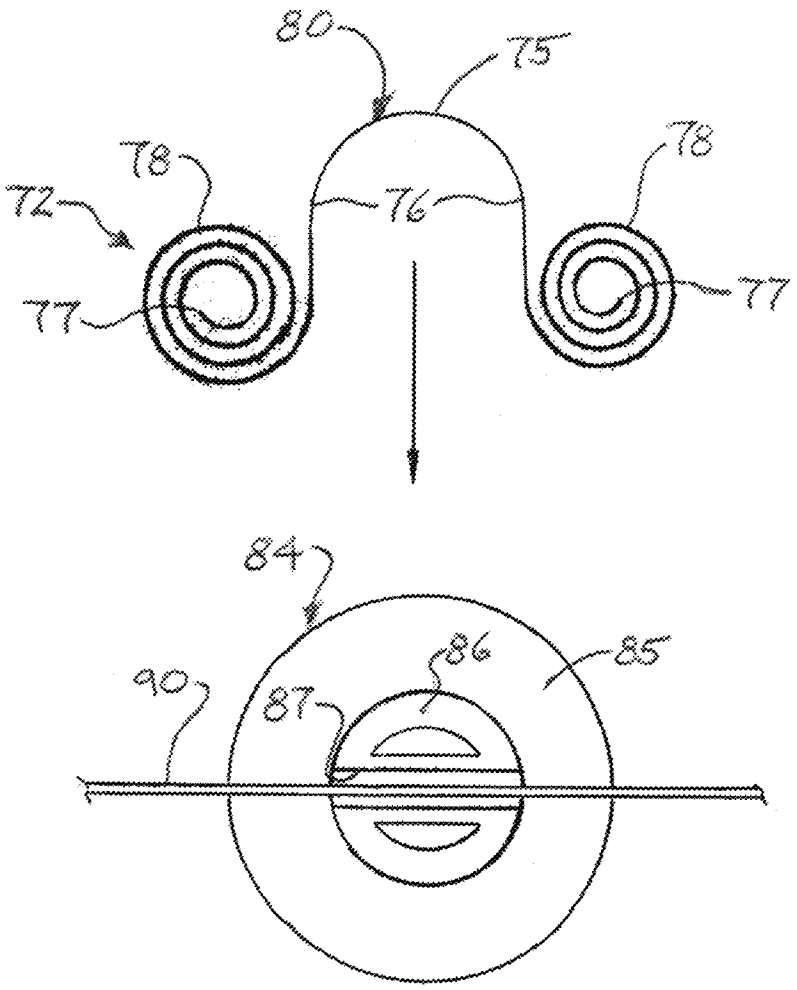
FIG. 21 is an exploded top view illustrating typical deployment of the coiled wire segment into engagement with the electrical insulator preparatory to wrapping the coiled wire segment on the electrical distribution line in attachment of the electrical distribution line to the electrical insulator.
Figure 22:
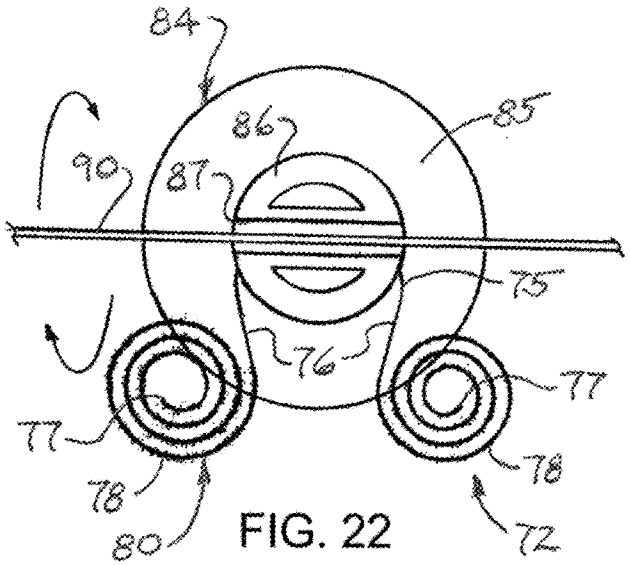
FIG. 22 is a top view of the coiled wire segment initially placed in engagement with the electrical insulator.
Figure 23:
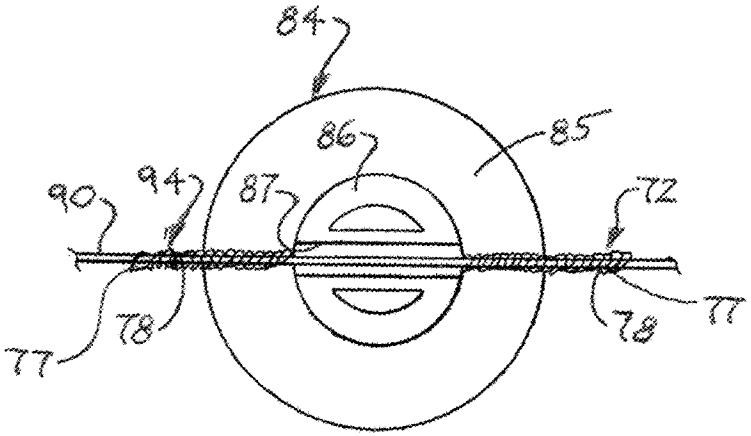
FIG. 23 is a top view of the coiled wire segment wound around the electrical distribution line to form a wrapped wire segment which completes securement of the electrical distribution line to the electrical insulator.

As illustrated in FIGS. 10-23 of the drawings, in typical application, the wire roller 1 may be operated to form a coiled wire segment 80 (FIG. 20) from a straight wire segment 74 (FIG. 10) of a tie wire 72. As illustrated in FIGS. 21-23, the coiled wire segment 80 may subsequently be applied to an electrical insulator 84 which supports an electrical distribution line 90 on a utility pole (not illustrated), for example and without limitation. The applied coiled wire segment 80 may be wrapped around the electrical distribution line 90 to form a wrapped wire segment 94 which secures the electrical distribution line 90 to the electrical insulator 84, as illustrated in FIG. 23 and will be hereinafter further described.

Figure 10:
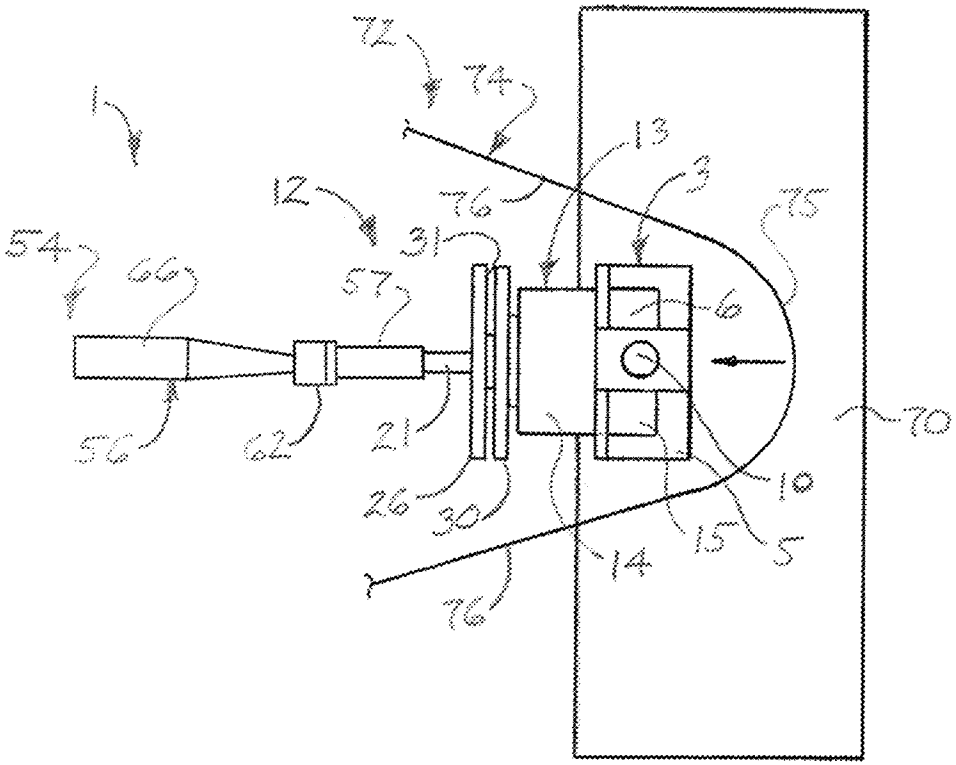
FIG. 10 is a top view of the wire roller mounted on the roller support surface, preparatory to application of a straight wire segment of a tie wire to a wire shaping peg of the wire roller in initial preparation of the tie wire segment to secure an electrical distribution line (not shown) to an electrical insulator (not shown) in typical application of the wire roller.
Figure 11:
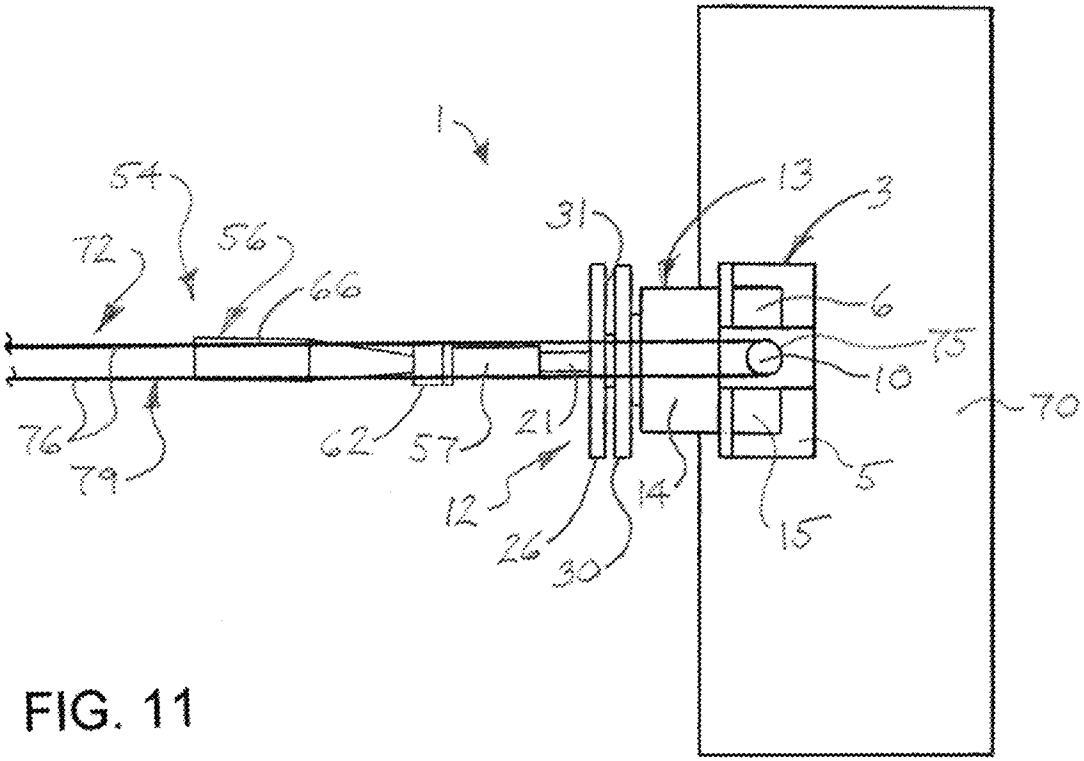
FIG. 11 is a top view of the wire roller illustrated in FIG. 10, after shaping of the straight wire segment of the tie wire into a looped wire segment having a wire segment loop and a pair of parallel wire segment portions extending from the wire segment loop.
Figure 12:
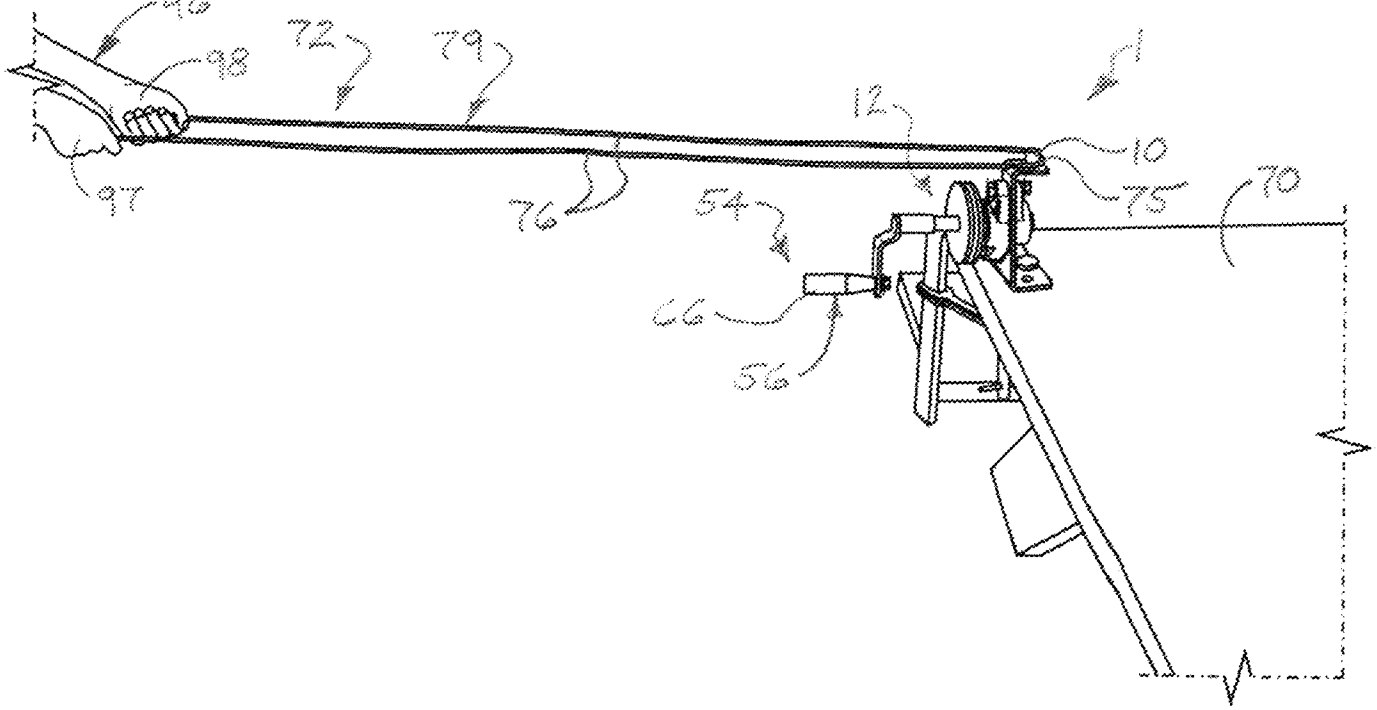
FIG. 12 is a perspective view of the wire roller illustrated in FIG. 10 as an operator of the wire roller pulls the wire segment portions to apply the wire segment loop against the wire shaping peg to form the looped wire segment.
Figure 14:
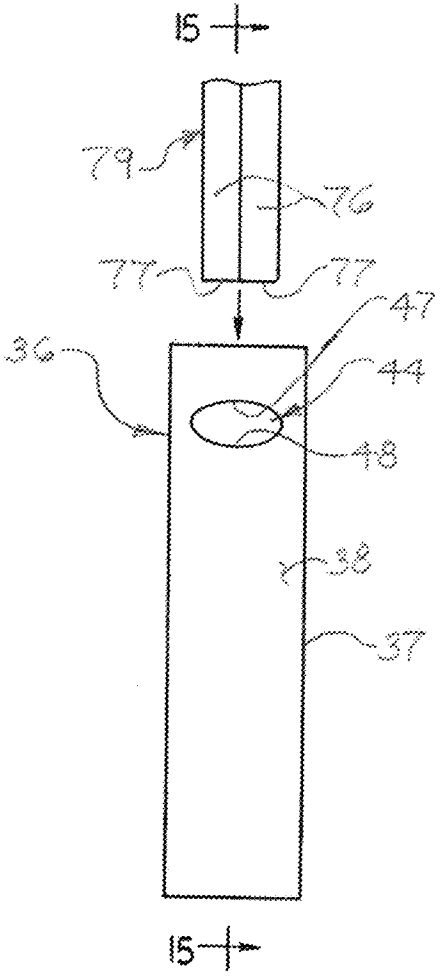
FIG. 14 is a side view of the wire roller disk of the wire roller assembly illustrated in FIG. 13, more particularly illustrating typical insertion of the wire segment ends of the looped wire segment into a wire receiving cavity in the wire roller disk preparatory to rolling the looped wire segment into the coiled wire segment.
Figure 17:
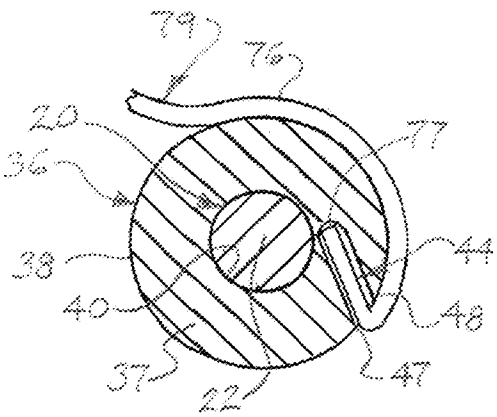
FIGS. 16-19 illustrate typical sequential snapshots of rotation of the wire roller disk of the wire roller assembly in formation of the looped wire segment into the coiled wire segment.
Figure 19:
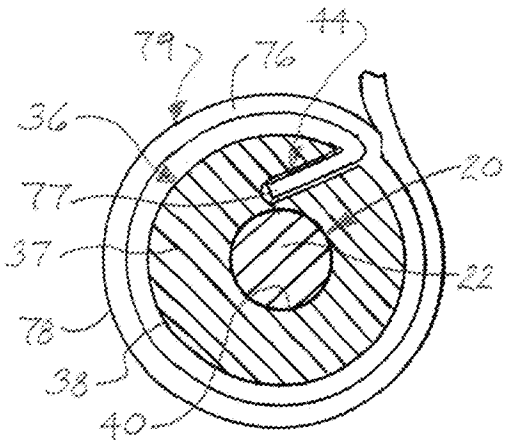
Figure 16:
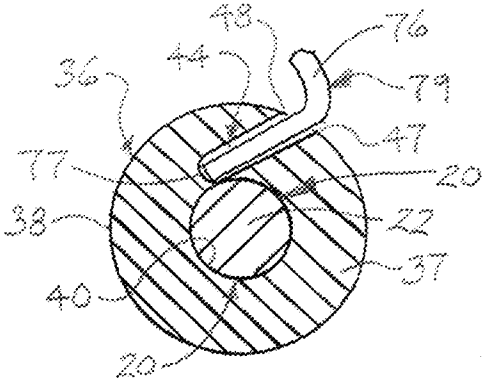
Figure 18:
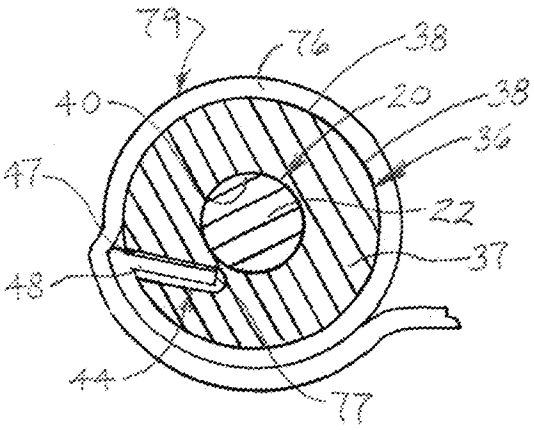

The tie wire 72 may be pulled, drawn or unspooled from a drum or spool (not illustrated) and cut to form the straight wire segment 74 having the opposite wire segment ends 77 (FIG. 14). As illustrated in FIGS. 10-12, an operator 96 (FIG. 12) of the wire roller 1 may initially grasp the straight wire segment 74 at the wire segment ends 77 using the right hand 97 and the left hand 98, respectively. The straight wire segment 74 (FIG. 10) may be formed into a looped wire segment 79, as illustrated in FIGS. 11 and 12, as the operator 96 pulls the middle of the straight wire segment 74 against the wire shaping peg 10 on the mount bracket 3 of the roller mount assembly 2. This action may form the looped wire segment 79 having a wire segment loop 75 which engages the wire shaping peg 10 and a pair of adjacent, parallel wire segment portions 76 which extend away from the wire segment loop 75 and terminate at the respective wire segment ends 77.

Figure 15:
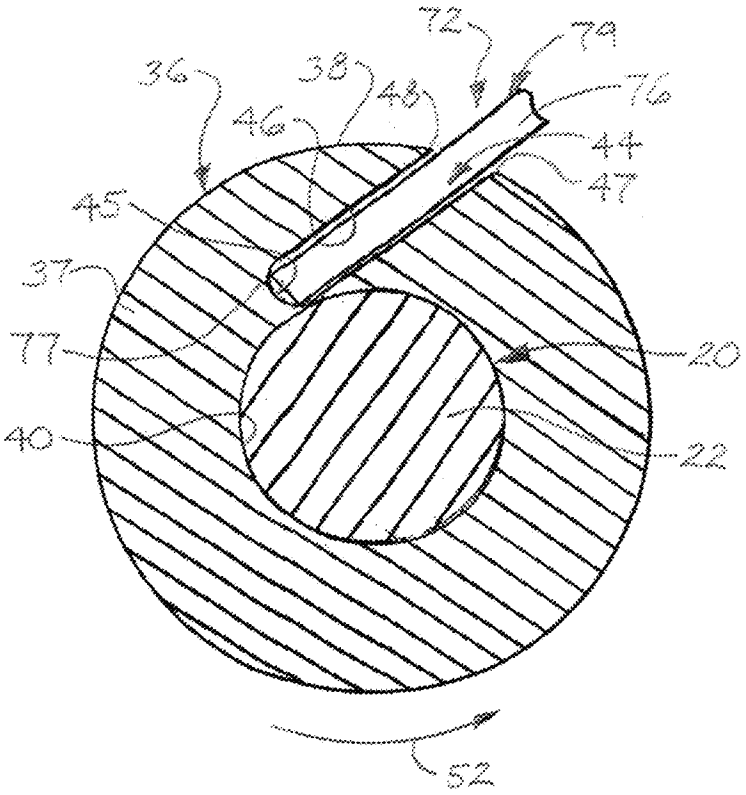
FIG. 15 is a sectional view, taken along section lines 15-15 in FIG. 14, of the wire roller disk and an end portion of the looped wire segment.

As illustrated in FIGS. 13-15, the wire segment ends 77 (FIG. 14) on the respective wire segment portions 76 of the looped wire segment 79 may be placed adjacent to each other and inserted into the wire receiving cavity 44 in the outer disk body surface 38 of the disk body 37. As illustrated in FIG. 15, the adjacent wire segment portions 76 may be inserted into the wire receiving cavity 44 typically until the wire segment ends 77 engage the inner cavity surface 45 of the wire receiving cavity 44. The roller assembly actuator 54 (FIGS. 1-5) may be operated to rotate the roller assembly shaft 20 of the wire roller assembly 12. As illustrated in FIG. 13, in some embodiments, the operator 96 may accomplish this by grasping the hand grip 66 of the actuator handle 56 typically using the right hand 97 while holding the looped wire segment 79 in place in the wire receiving cavity 44 using the left hand 98. Accordingly, as illustrated in FIGS. 16-19, the rear shaft segment 22 of the roller assembly shaft 20 may rotate the wire roller disk 36 in the direction of rotation 52 (clockwise in FIGS. 16-19) such that the wire segment portions 76 of the looped wire segment 79 are progressively wound around the outer disk body surface 38 of the disk body 37 of the wire roller disk 36. The coiled wire segment 80 is thus formed within the roller space 31 between the front roller assembly plate 26 and the rear roller assembly plate 30 of the wire roller assembly 12, with a pair of wire segment coils 78 (FIG. 20) formed in parallel, adjacent relationship to each other in the respective wire segment portions 76 and with the wire segment loop 75 connecting the wire segment coils 78.

The coiled wire segment 80 may be removed from the roller space 31 typically by initially removing the rear shaft segment 22 of the roller assembly shaft 20 from the shaft receptacle 32 on the rear roller assembly plate 30 as the shaft receptacle 32 typically remains in place in the shaft bore 18 (FIG. 6) of the roller assembly bearing 13. The initially parallel, adjacent wire segment coils 78 of the coiled wire segment 80 may then be slid off the end of the rear shaft segment 22. In some applications, the rear shaft segment 22 of the roller assembly shaft 20 may next be inserted back in place in the shaft receptacle 32 preparatory to formation of another coiled wire segment 80 from a straight wire segment 74, typically as was heretofore described.

Figure 20:
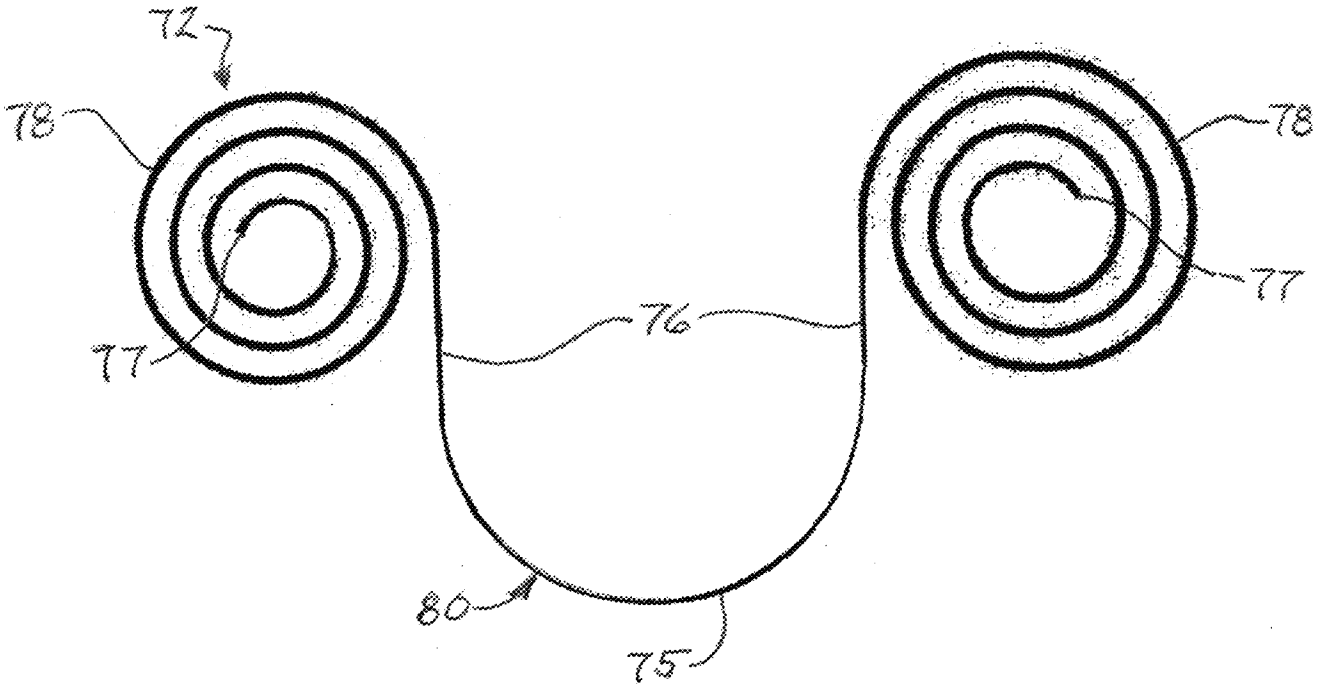
FIG. 20 is a top view of a typical coiled wire segment formed from the looped wire segment.

As illustrated in FIG. 20, after the coiled wire segment 80 is removed from the wire roller assembly 12, the wire segment loop 75 of the coiled wire segment 80 may be straightened such that the wire segment coils 78 are reoriented from being disposed in parallel, adjacent relationship to being disposed in spaced-apart relationship with each other on opposite sides of the wire segment loop 75. Accordingly, the wire segment loop 75 and the wire segment coils 78 are typically disposed within a common plane. As illustrated in FIG. 21, the coiled wire segment 80 may next be deployed into engagement with the electrical insulator 84. The electrical insulator 84 may be standard or conventional with a typically ceramic insulator base 85 and a wire support cradle 86 on the insulator base 85. An insulator neck (not illustrated) may connect the wire support cradle 86 to the insulator base 85. An elongated line receiving channel 87 may extend transversely across the width of the wire cradle 86. The electrical distribution line 90 may lie within the line receiving channel 87.

As further illustrated in FIGS. 21 and 22, the wire segment loop 75 of the coiled wire segment 80 may be placed into engagement with the insulator neck (not illustrated) which connects the wire support cradle 86 to the insulator base 85. As illustrated in FIG. 22, the wire segment coils 78 of the coiled wire segment 80 may next be wound in a pair of parallel circular paths around the electrical distribution line 90 to form a wrapped wire segment 94 which completes securement of the electrical distribution line 90 to the electrical insulator 84. It will be recognized and appreciated by those skilled in the art that the application of the wire roller 1 to form the coiled wire segment 80 from the initially straight wire segment 74 of the tie wire 72 represents only an exemplary application of the wire roller 1 and the wire roller 1 may be used to form one or more loops or coils in wire segments for any of a variety of applications.

While certain illustrative embodiments of the disclosure have been described above, it will be recognized and understood that various modifications can be made to the embodiments and the appended claims are intended to cover all such modifications which may fall within the spirit and scope of the disclosure.

I claim:

1. A wire roller configured to roll a wire segment, the wire roller comprising:

a roller mount assembly;

a wire roller assembly comprising:

a roller assembly bearing carried by the roller mount assembly;

a rotatable roller assembly shaft;

a first roller assembly plate fixedly carried by the roller assembly shaft, the roller assembly shaft comprising a first shaft segment on a first side of the first roller assembly plate and a second shaft segment on a second side of the first roller assembly plate;

a shaft receptacle inserted in the roller assembly bearing and removably receiving the second shaft segment of the roller assembly shaft;

a second roller assembly plate carried by the shaft receptacle;

a roller space between the first roller assembly plate and the second roller assembly plate; and a wire roller disk in the roller space, the wire roller disk comprising:

a disk body engaged for rotation by the second shaft segment of the roller assembly shaft; and a wire receiving cavity in the disk body, the wire receiving cavity sized and configured to releasably retain at least one end of the wire segment;

a roller assembly actuator operably engaging the first shaft segment of the roller assembly shaft for rotation of the roller assembly shaft and the wire roller disk, whereby the wire roller disk is configured to roll the wire segment responsive to rotation of the roller assembly shaft by operation of the roller assembly actuator; and the second roller assembly plate selectively removable with respect to the roller assembly shaft by removal of the second shaft segment from the shaft receptacle for removal of the wire segment from the roller space after rolling of the wire segment.

2. The wire roller of claim 1 wherein the roller assembly actuator comprises an actuator handle.

3. The wire roller of claim 1 wherein the roller assembly actuator comprises an actuator motor.

4. The wire roller of claim 1 wherein the roller mount assembly comprises a mount bracket and the roller assembly bearing is carried by the mount bracket, and further comprising a wire shaping peg on the roller mount assembly.

* * * * *